United States Patent [19]

Shimoda et al.

[11] 4,400,687

[45] Aug. 23, 1983

[54] HOUSING FOR USE WITH A VARIABLE RESISTOR

[75] Inventors: Eitaro Shimoda; Kiyoshi Yamashita, both of Yokohama, Japan

[73] Assignee: Sakae Tsushin Kogyo Co. Ltd., Japan

[21] Appl. No.: 304,039

[22] Filed: Sep. 21, 1981

[30] Foreign Application Priority Data

Oct. 14, 1980 [JP] Japan ..... 55-145836[U]

[51] Int. Cl.[3] ..... H01C 1/02; H01C 10/00

[52] U.S. Cl. ..... 338/184; 338/143; 338/164; 338/199

[58] Field of Search ..... 338/143, 141, 199, 184, 338/164; 200/303; 361/392, 429

[56] References Cited

U.S. PATENT DOCUMENTS 3,648,217 3/1972 DeLong et al. ..... 338/143

4,081,780 3/1978 Rhind et al. ..... 338/143 X

FOREIGN PATENT DOCUMENTS 37-896085 5/1962 Japan ..... 338/143

*Primary Examiner*—C. L. Albritton

*Attorney, Agent, or Firm*—Hill, Van Santen, Steadman & Simpson

[57] ABSTRACT

A housing for use with a variable resistor consisting of a spiral resistance element, a rotary shaft, a conductive slide plate and a top is disclosed. The housing includes a cylindrical body for supporting on its inner surface the resistance element, a first cylindrical panel engaged with one open end of the cylindrical body to close the open end and rotatably supporting the rotary shaft, a second cylindrical panel engaged with the other open end of the cylindrical body and rotatably supporting the rotary shaft, at least one pair of resilient engaging projections extended from at least one of the first and second cylindrical panels along the axis of the cylindrical body, and engaging recesses formed on an outer periphery of the cylindrical body at predetermined positions and respectively engaging with the resilient engaging projections when the first and second cylindrical panels are engaged with the cylindrical body to make up the housing for the variable resistor.

7 Claims, 9 Drawing Figures

HOUSING FOR USE WITH A VARIABLE RESISTOR

BACKGROUND OF THE INVENTION

1. Field of the Invention

The present invention relates generally to a housing for use with a variable resistor and more particularly to a housing for use with a variable resistor which can be assembled very easily.

2. Description of the Prior Art

A conventional housing for a variable resistor is such, for example, as shown in FIGS. 1 and 2, in which it comprises a disc-shaped top panel 3 having a bearing portion 2 for rotatably supporting an upper portion of a rotary shaft 1, a cylindrical body 6 having a spiral groove 4 formed on its inner surface 6*a* for mounting a spiral resistance element 5, and a disc-shaped bottom panel 8 having a bearing 7 for rotatably supporting the lower end of the rotary shaft 1.

The rotary shaft 1 has fixed thereon an insulating cylindrical slide member 1*a* to be rotated therewith. A top 9 is provided with clearance from the outer surface of the slide member 1*a* and the inner surface 6*a* of the body 6 to be rotatable therewith and also slidable thereon in the lengthwise direction of the rotary shaft 1 white being guided by the spiral resistance element 5 by the cooperation of elongated projections 1*b* provided on the outer surface of the slide member 1*a* along its lengthwise direction and recesses 9*a* formed in the inner surface of the top 9 each engaging with the projection 1*b*. Between a slide plate 10 of a conductive material, mounted on one side surface of the slide member 1*a* along the axial direction of the shaft 1, and the resistance element 5, disposed is a spring 11 both ends of which make sliding contact with them, respectively (see FIG. 2). A contact 12 is provided at the lower end of the slide plate 10 and held in sliding contact with a circular conductive member 14 connected to an output terminal 13 (see FIG. 3). The spiral resistance element 5 is connected at both ends to a pair of input terminals 15 and 16, respectively (see FIG. 3).

By the way, since the top and bottom panels 3 and 8 and the resistance element mounting body 6, which make up the housing for the variable resistor, are fixed together by means of screws 19 and 20, as illustrated, the assembling of the housing is troublesome and the screws 19 and 20 are likely to get lost during maintenance and inspection of the variable resistor and, in addition, the subsequent reassembling is not easy.

FIG. 3 shows another prior art example of the housing of this kind, in which the top and bottom panels 3 and 8 and the resistance element mounting body 6 are fixed together, using a pair of bands 23 and 24 and screws 25 and 26. Also in this case, however, the assembling work is relatively cumbersome and the screws 25 and 26 are liable to be lost during maintenance and inspection of the variable resistor.

SUMMARY OF THE INVENTION

Accordingly, it is an object of the present invention to provide a housing for use with a variable resistor which is simple-structured, easy to be assembled and hence is suitable for mass-production of variable resistors.

According to an aspect of the present invention there is provided a housing for use with a variable resistor consisting of a resistance element, a rotary shaft, a conductive slide plate and a top, said housing comprising:

(a) a cylindrical body for supporting on its inner surface said resistance element;

(b) a first cylindrical panel engaged with one open end of said cylindrical body to close the open end and rotatably supporting said rotary shaft;

(c) a second cylindrical panel engaged with the other open end of said cylindrical body and rotatably supporting said rotary shaft;

(d) at least one pair of resilient engaging projections extended from at least one of said first and second cylindrical panels along the axis of said cylindrical body; and (e) engaging recesses formed on an outer periphery of said cylindrical body at predetermined positions and respectively engaging with said resilient engaging projections when said first and second cylindrical panels are engaged with said cylindrical body to make up said housing for the variable resistor.

The other objects, features and advantages of the present invention will become apparent from the following description taken in conjunction with the accompanying drawings through which the like references designate the same elements and parts.

DESCRIPTION OF THE PREFERRED EMBODIMENTS

Figure 1:
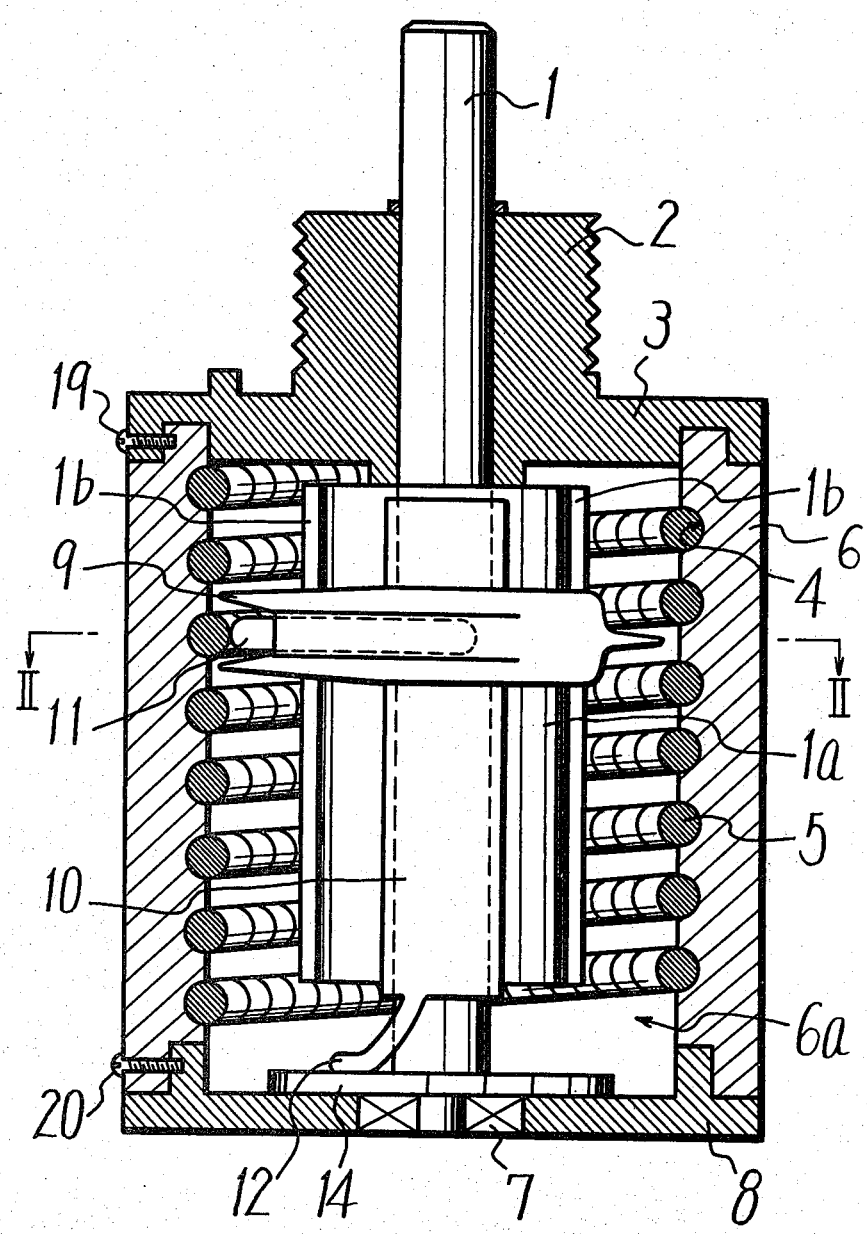
FIG. 1 is a sectional view showing an example of a conventional housing for use with a variable resistor.
Figure 2:
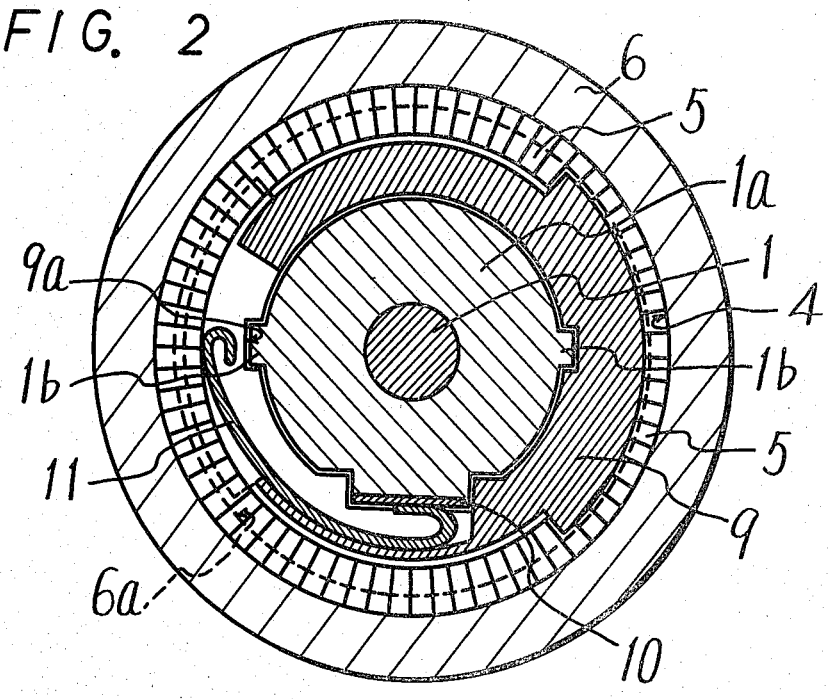
FIG. 2 is a sectional view taken along the line II—II in FIG. 1.
Figure 5:
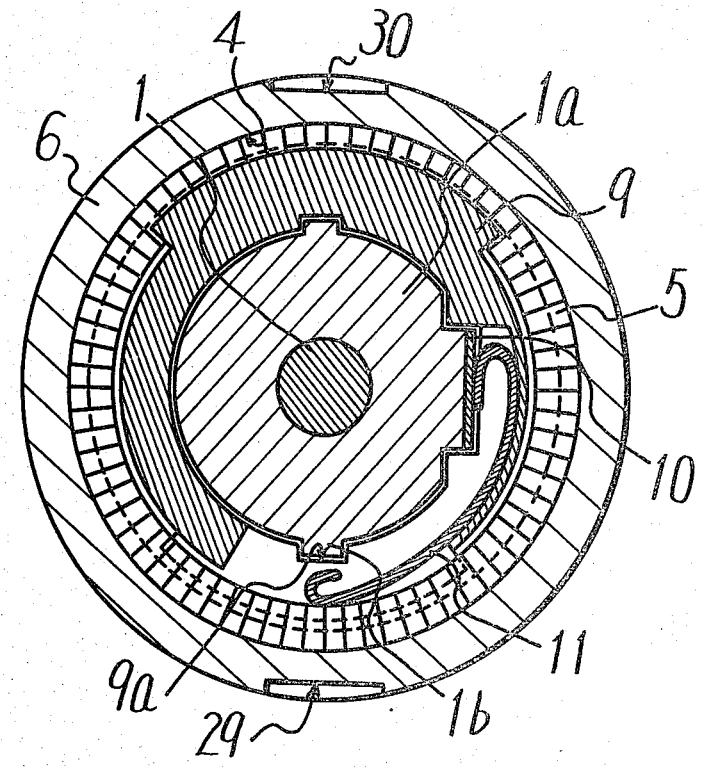
FIG. 5 is a sectional view taken along the line V—V in FIG. 4.
Figure 3:
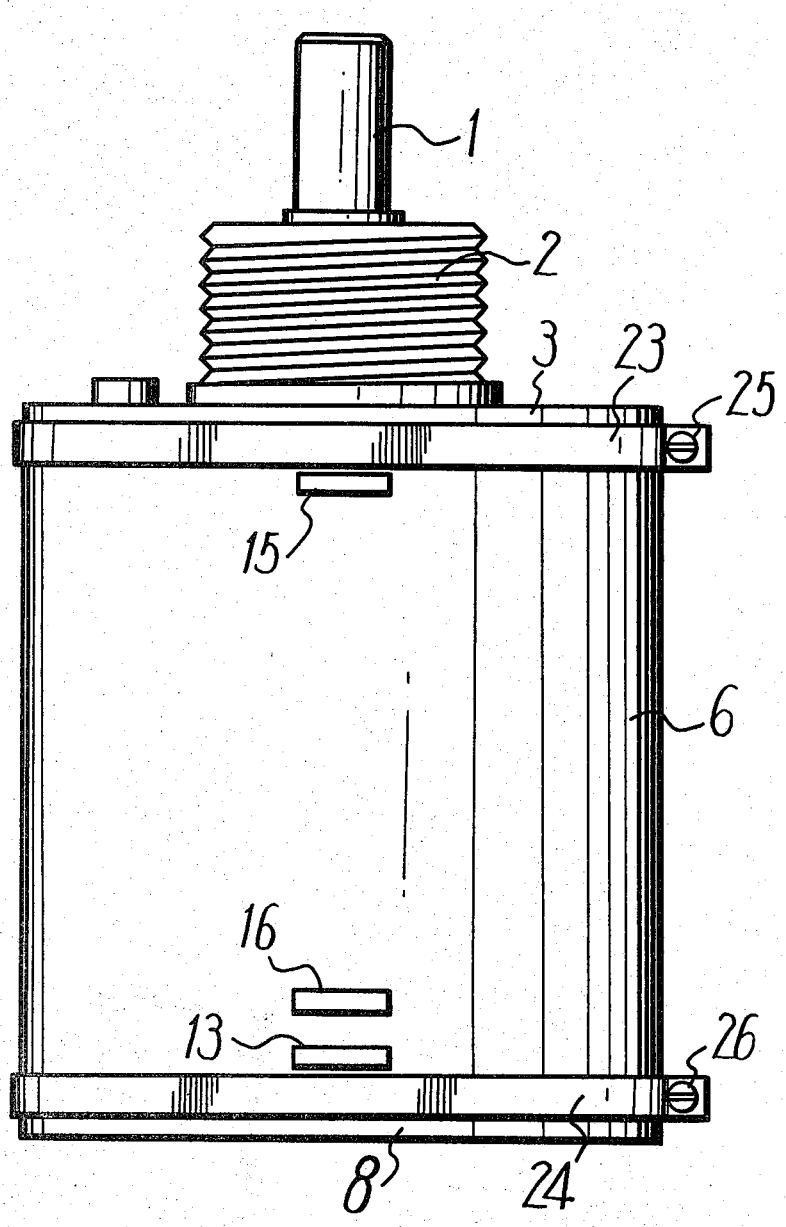
FIG. 3 is a side view showing another example of the conventional housing for use with a variable resistor.
Figure 4:
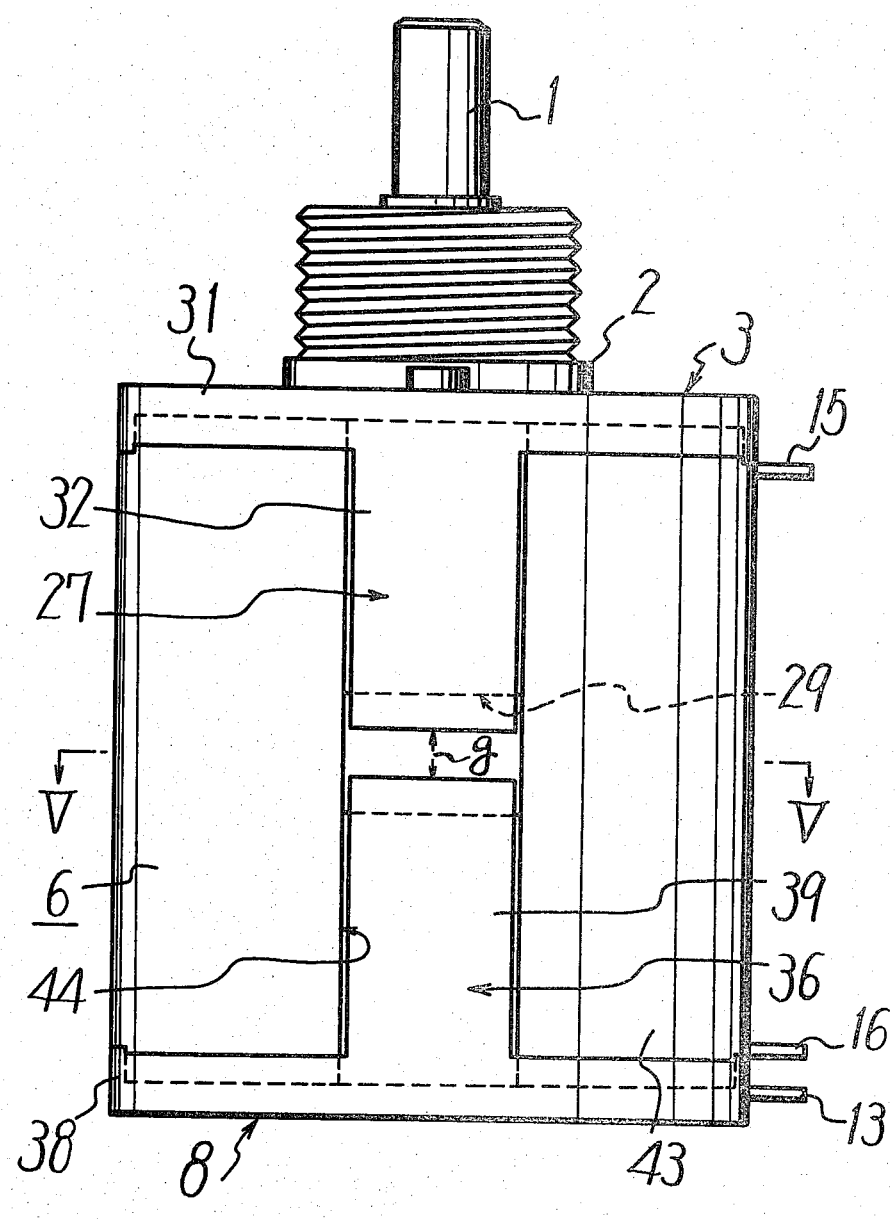
FIG. 4 is a side view illustrating an embodiment of the housing for use with a variable resistor according to the present invention.
Figure 6:
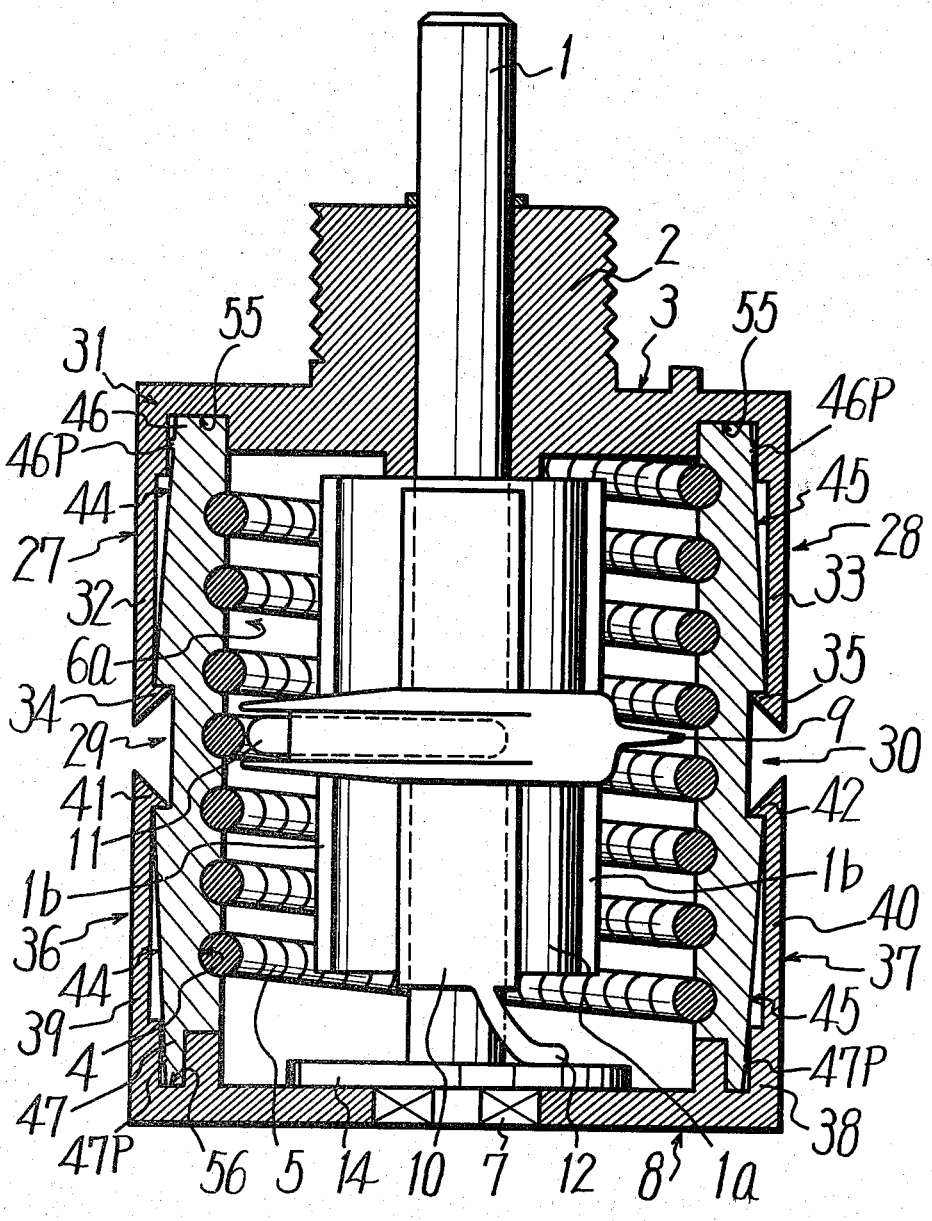
FIG. 6 is a sectional view illustrating the principal part of the embodiment depicted in FIG. 4.

A detailed description will be given, with reference to FIGS. 4 to 6, of an embodiment of the housing for use with a variable resistor according to the present invention. In FIGS. 4 to 6, the parts corresponding to those in FIGS. 1, 2 and 3 are identified by the same reference numerals.

The housing for use with a variable resistor of the illustrated embodiment according to the invention comprises top and bottom cylindrical panels 3 and 8 and a cylindrical resistance element mounting body 6. The top and bottom cylindrical panels 3 and 8 respectively have at least one pair of resilient engaging projections 27, 28 and 36, 37 formed from their outer cylindrical bodies 31 and 38. That is, the projections 27, 28 and 36, 37 are elongated along the axis of the shaft 1 in the direction such that the free ends of the former face the free ends of the latter with a clearance or gap g as illustrated in FIG. 4. The resistance element mounting body 6 has formed in its outer peripheral surface 43 at predetermined positions recesses 29 and 30 for engagement with the abovesaid engaging projections 27, 28 and 36, 37, as will be described later in detail.

The top cylindrical panel 3 is a cylindrical or cup-shaped member having its one end closed. In the illustrated example, the top cylindrical panel 3 is formed of an elastic resin of high heat resistance, and at least one pair of engaging projections 27 and 28 are formed integral with the cylindrical body 31 at predetermined positions. The engaging projections 27 and 28 are respectively composed of plate-like portions 32 and 33 formed integrally with the top cylindrical panel 3 or the cylindrical body 31 to extend in its axial direction and hooked members 34 and 35 respectively formed at the tip end portions of the plate-like portions 32 and 33. The engaging projections 27 and 28 are spaced apart at an angular distance of about 180° in the illustrated embodiment.

The top cylindrical panel 3 has formed on the inside of its disc-shaped portion such a ring-shaped groove 55 as shown in FIG. 6 so that the upper end of the resistance element mounting body 6 is fitted into the ring-shaped groove 55.

The bottom cylindrical panel 8 is also formed with a ring-shaped groove 56 on the inside of its disc-shaped portion and provided with the pair of engaging projections 36 and 37. Reference numerals 39 and 40 indicate plate-like portions thereof similar to those 32 and 33 of the top panel 3, and 41 and 42 designate hooked members respectively formed at their free end portions.

A pair of grooves 44 and 45 for guiding the abovesaid plate-like portions 32, 33 and 39, 40 are cut on the outer peripheral surface 43 of the resistance element mounting body 6 at diametrically opposite positions to extend in the axial direction of the body 6. At the center portions of the grooves 44 and 45, formed are the engaging recesses 29 and 30 for engagement with the hooked members 34, 35 and 41, 42 of the engaging projections 27, 28 and 36, 37, respectively.

The upper and lower end portions of the resistance element mounting body 6 are selected slightly smaller in outer diameter or in thickness of its cylindrical portion than the central portion thereof to form small-diametered or thin thickness portions 46 and 47, which are fitted into the grooves 55 and 56 of the top and bottom cylindrical panels 3 and 8, respectively, as shown in FIG. 6.

According to the housing for use with a variable resistor of the invention as described above, the top panel 3 and the resistance element mounting body 6 can be assembled together only by fitting the latter into the former and sliding down the plate-like portions 32 and 33 of the engaging projections 27 and 28 along the grooves 44 and 45 to bring the hooked members 34 and 35 into engagement with the engaging recesses 29 and 30, respectively. As a result of this, the top panel 3 and the resistance element mounting body 6 are tightly secured to each other by the elasticity of the engaging projections 27 and 28. The bottom panel 8 is also assembled with the resistance element mounting body 6 in the same manner as mentioned above in connection with the top panel 3. The housing thus assembled can be disassembled easily by respectively disengaging the hooked members 34, 35 and 41, 42 from the engaging recesses 29 and 30, by inserting a small screwdriver or the like into a gap g between the free ends of the facing engaging projections 27 and 36 (28 and 37) shown in FIG. 4 and releasing the engagements. In this case, as shown in FIG. 6, if circular or splitted circular projections **46*p* and 47*p* are respectively formed on the outer surfaces of the small-diametered portions 46 and 47 of the body 6, the portions 46 and 47 can be fitted into the grooves 55 and 56 more firmly or the portions 46 and 47 are prevented from being unnecessarily disengaged from the grooves 55 and 56** when they are engaged once.

Figure 7:
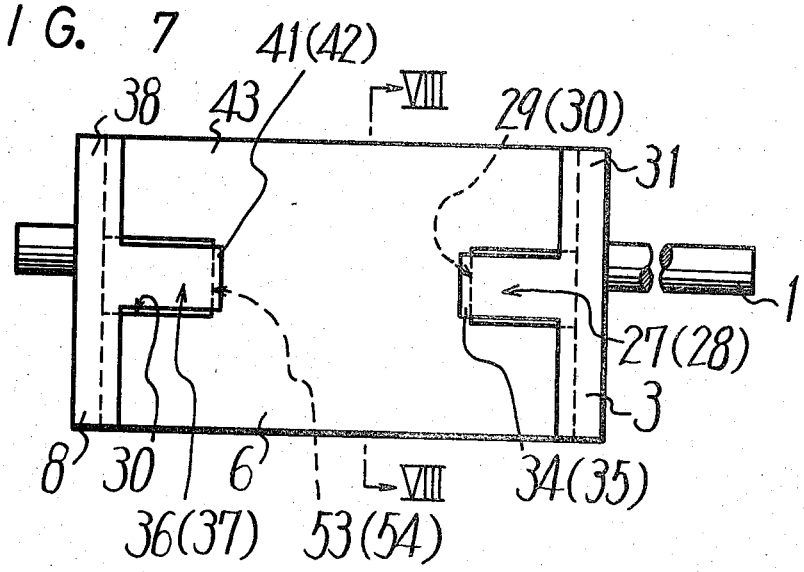
FIG. 7 is a front view showing another embodiment of the present invention.
Figure 8:
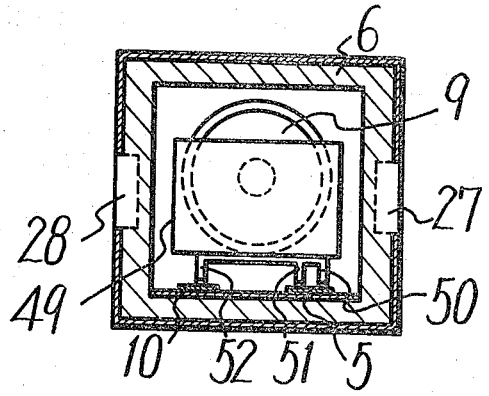
FIG. 8 is a sectional view taken on the line VIII—VIII in FIG. 7.
Figure 9:
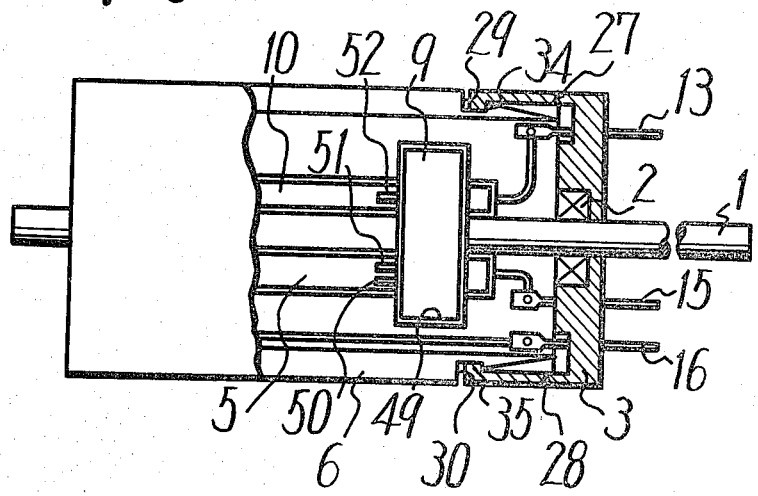
FIG. 9 is a partially sectional view showing the principal part of the embodiment of FIG. 7.

FIGS. 7 through 9 illustrate another embodiment of the housing for use with a variable resistor according to the present invention as being applied to a linear-sliding-type variable resistor. In this embodiment, the housing has a square-bar configuration and also comprises the resistance element mounting body 6 and the panels 3 and 8 as is the case with the above embodiment. The rotary shaft 1 projecting out from both ends of the housing or beyond the panels 3 and 8 is adapted to be rotatable and slidable in the lengthwise direction of the resistance element mounting body 6, and the top 9 described later is slidably mounted on the rotary shaft 1 substantially centrally thereof. The resistance element 5 and the slide plate 10 are disposed lengthwise of the resistance element mounting body 6 and both ends of the resistance element 5 are connected to the input and output terminals 15 and 16, respectively, and one end of the slide plate 10 is connected to the output terminal 13. The top 9 is mounted in a case 49 which has formed on the underside thereof three contacts 50, 51 and 52 arranged in an E-letter form. When the rotary shaft 1 has been rotated to move in the lengthwise direction of the resistance element mounting body 6, the three contacts 50, 51 and 52 slide on the resistance element 5 and the slide plate 10.

In such a housing of this embodiment, the panel 3 has formed integrally therewith the engaging projections 27 and 28 respectively provided with the hooked members 34 and 35 and, likewise, the other panel 8 has also formed integrally therewith the engaging projections 36 and 37 respectively provided with the hooked members 41 and 42. The resistance element mounting body 6 has the engaging recesses 29, 30 and 53, 54 in opposing relation to the hooked members 34, 35, 41 and 42 of the engaging projections 27, 28 and 36, 37, respectively, and engaging them with each other, the housing is assembled.

Also in this case, the housing can easily be disassembled by disengaging the hooked members 34, 35 and 41, 42 of the engaging projections 27, 28 and 36, 37 from the recesses 29, 30 and 53, 54, using a screwdriver or the like similar to the above case.

Since the housing for use with a variable resistor of this invention can be assembled only by engaging the panels with the resistance element mounting body through the abovesaid engaging members, as described above, the number of steps involved in the assembling of the housing can substantially be reduced. In addition, the housing is easy to assemble, and hence is suitable for mass production; furthermore, the housing requires a small number of parts therefor and this leads to a marked reduction of the manufacturing costs of variable resistors.

Moreover, since the housing of this invention can easily be disassembled by the use of a screwdriver, or the like, the inspection or adjustment of the variable resistor can be performed with much ease.

It is also possible to provide for each panel a plurality of pairs of such engaging projections as mentioned above.

The above description is given on a preferred embodiments of the invention, but it will be apparent that many modifications and variations could be effected by one skilled in the art without departing from the spirits or scope of the novel concepts of the invention, so that the scope of the invention should be determined by the appended claims only.

We claim as our invention:

1. A housing for use with a variable resistor consisting of a resistance element, a rotary shaft, a conductive slide plate and a top, said housing comprising:

(a) a cylindrical body for supporting on its inner surface said resistance element, said cylindrical body having on its outer surface grooves elongated along its lengthwise direction;

(b) a first cylindrical panel engaged with one open end of said cylindrical body to close the open end and rotatably supporting said rotary shaft;

(c) a second cylindrical panel engaged with the other open end of said cylindrical body and rotatably supporting said rotary shaft;

(d) at least one pair of resilient engaging projections extended from at least one of said first and second cylindrical panels along the axis of said cylindrical body, each of said pair of resilient engaging portions being formed as a plate-like shape and being guided by said grooves; and (e) engaging recesses formed on an outer periphery of said cylindrical body at predetermined positions and respectively engaging with said resilient engaging projections when said first and second cylindrical panels are engaged with said cylindrical body to make up said housing for the variable resistor.

2. A housing for use with a variable resistor as claimed in claim 1, in which said first and second cylindrical panels each have said resilient engaging projections.

3. A housing for use with a variable resistor as claimed in claim 1, in which each of said engaging projections has a hook at its free end portion which engages with said engaging recess.

4. A housing for use with a variable resistor as claimed in claim 1, in which both end portions of said cylindrical body are selected in outer diameter smaller than the central portion thereof.

5. A housing for use with a variable resistor as claimed in claim 1, in which each of said first and second cylindrical panels has a circular groove on its inner surface to be engaged with one end of said cylindrical body upon assembling.

6. A housing for use with a variable resistor as claimed in claim 5, in which a circular projection is formed on the outer surface of each of end portions of said cylindrical body to abut against wall of said circular groove formed on the inner surface of each of said first and second cylindrical panels.

7. A housing for use with a variable resistor as claimed in claim 2, in which the length of said resilient engaging portions of said first and second cylindrical panels are selected such that free ends thereof face each other with a clearance on said engaging recesses.

* * * * *